US008827218B2

(12) United States Patent
Saunders

(10) Patent No.: US 8,827,218 B2
(45) Date of Patent: Sep. 9, 2014

(54) PAINT STAND SYSTEM AND METHOD OF USE THEREOF

(76) Inventor: Lamoine Saunders, Chandler, AZ (US)

( * ) Notice: Subject to any disclaimer, the term of this patent is extended or adjusted under 35 U.S.C. 154(b) by 149 days.

(21) Appl. No.: 13/398,479

(22) Filed: Feb. 16, 2012

(65) Prior Publication Data

US 2012/0207937 A1 Aug. 16, 2012

Related U.S. Application Data

(60) Provisional application No. 61/443,364, filed on Feb. 16, 2011.

(51) Int. Cl.
*A47G 23/02* (2006.01)
*B05B 13/02* (2006.01)

(52) U.S. Cl.
CPC ..... *B05B 13/0285* (2013.01)
USPC ..... 248/154; 248/176.1

(58) Field of Classification Search
USPC ..... 269/43, 71, 95, 289 R, 45; 211/22, 24, 211/197, 64, 13.1; 248/127, 128, 146, 145, 248/150, 151, 153, 154, 176.1, 176.2, 177.1
See application file for complete search history.

(56) References Cited

U.S. PATENT DOCUMENTS

| | | | | | |
|---|---|---|---|---|---|
| 1,981,294 | A * | 11/1934 | Wangen | 211/11 |
| 2,077,668 | A * | 4/1937 | Bristol | 248/86 |
| 2,669,958 | A * | 2/1954 | Sweeney | 269/45 |
| 2,803,872 | A * | 8/1957 | Massa | 269/37 |
| 4,756,429 | A * | 7/1988 | Lehman et al. | 211/43 |
| 7,445,184 | B1 * | 11/2008 | Johnson | 248/176.1 |
| 2002/0007703 | A1 * | 1/2002 | Michel Gelos | 81/385 |

* cited by examiner

*Primary Examiner* — Alfred J Wujciak
(74) *Attorney, Agent, or Firm* — Schmeiser, Olsen & Watts LLP

(57) ABSTRACT

A paint stand system is provided. The system has a base and a podium. The base has a support and a shaft extending from the support and the podium has a hollow shaft, a stage coupled to the hollow shaft at the midway point of the stage, and a compliant clamp mechanism coupled proximate to each distal end of the stage. The hollow shaft of the podium is configured to slip over the shaft of the base, such that the podium is supported by the base and rotates about the shaft, which allows the podium to rotate around the base. In other words, while the base is stationary, the podium can be rotated through an entire 360° rotation. The compliant clamp mechanism operates to grip an object and to suspend the object so that an operator can work with or apply paint and other decorative features to the object.

15 Claims, 5 Drawing Sheets

PAINT STAND SYSTEM AND METHOD OF USE THEREOF

CROSS REFERENCE TO RELATED APPLICATION[S]

This application claims priority to U.S. Provisional Patent Application to LaMoine Saunders entitled "PINEWOOD DERBY PAINT STAND," Ser. No. 61/443,364, filed Feb. 16, 2011, the disclosure of which is hereby incorporated entirely herein by reference.

BACKGROUND

1. Technical Field

The present disclosure relates generally to painting stands, and in particular to a paint stand for use with an object to be decorated.

2. State of the Art

Local units, districts and/or councils of the Boy Scouts of America® (BSA) hold an annual event, called the Pinewood Derby®, wherein young participants, with the help of parents or leaders, build their own cars from wood, usually from kits containing a block of pine, plastic wheels, and metal axles. Other organizations, including Awana®, hold similar events such as the Awana Grand Prix. These organizations also utilize a block of pine similar to the block of pine used by the BSA Pinewood Derby®.

The block of pine in the various kits comes pre-cut with slits running width-wise along a bottom surface of the block, wherein the plastic wheels can be attached to the block by inserting the metal axles through the wheels and into the slits. If the kit is not utilized, then the participant may in some cases utilize a piece of wood that conforms to the BSA® Pinewood Derby® racing specifications and regulations, which include: the overall length of the car shall not exceed 7 inches; the overall width of the car shall not exceed 2¾ inches; the car must have 1¾ inches clearance between the wheels; and the car must have ⅜ inch clearance underneath the body so it does not rub on the track. Other races may have differing regulations and requirements and participants will utilize a block of wood that conforms to these requirements.

Prior to attaching the plastic wheels to the pine block by way of the metal axles, the young participants with the help of their parents design, create, and build a uniquely styled car. Each young participant carves out the car design from the original pine block of wood until the original pine block of wood assumes the desired shape of the car. For example, shapes of Pinewood Derby® cars include: a sports car, an aerodynamic wedge, a hot dog, a coffin, a pickle, a pencil, and a shark, just to name a few. In fact, the design possibilities are as endless as one's imagination, as long as the design conforms to the BSA® Pinewood Derby® racing regulations, or other racing requirements, noted above. After achieving the desired design, the young participant subsequently applies coloring, paint, or decals to decorate the car. Once decorated, the wheels and axles may be attached.

The decoration of the car can be an elaborate process, wherein the young participant may desire to paint, or otherwise color, the car with many different colors and textures. The participant may desire to apply several layers of paint to the car or may desire to color different sections of the car in different colors. The participant may also desire to apply decals and other finishing details to complete the decoration.

However, it can be difficult to adequately and efficiently support the car during the decorating process. Thus, there is a need to develop a paint stand that provides sufficient support and access to the car to permit the young participant to efficiently decorate the pine block during preparation of the car.

SUMMARY

The present disclosure relates generally to painting stands, and in particular to a paint stand for use with a wooden block of pine. These blocks of pine are often included in a Pinewood Derby® kit. However, the present disclosure may also be utilized with a block of wood carved to satisfy Pinewood Derby® racing specifications or other racing requirements.

An aspect of the present disclosure includes the paint stand system comprising a base, a podium configured to be repeatedly and releasably coupled to the base, and a plurality of clamping mechanisms functionally coupled to the podium, each of the plurality of clamping mechanisms having a pair of opposing ends that are elastically biased toward one another, wherein the podium is configured to rotate with respect to the base.

Another aspect of the present disclosure includes the base further comprising a projection thereon, the projection extending transversely from the base and the projection being configured to engage the podium.

Another aspect of the present disclosure includes the podium further comprising a hollow protrusion, the hollow protrusion being configured to engage the projection.

Another aspect of the present disclosure includes the podium further comprising a stage having distal ends, wherein the stage is fixedly coupled to the projection at a center portion of the stage, and wherein the plurality of clamping mechanisms are fixedly coupled to the stage proximate the distal ends.

Another aspect of the present disclosure includes each pair of opposing ends defining a gap between the opposing ends.

Another aspect of the present disclosure includes each of the plurality of clamping mechanisms defining therebetween a workspace proximate the gap, the workspace defining a space between the clamping mechanisms below the gap and wider than the gap.

An aspect of the present disclosure includes a paint stand system for securing therein an object to be painted, the system comprising a base, a podium configured to be repeatedly and releasably coupled to the base, an object, and a plurality of clamping mechanisms functionally coupled to the podium, each of the plurality of clamping mechanisms having a pair of opposing ends that are elastically biased toward one another to secure the object therebetween, wherein the podium is configured to rotate with respect to the base.

Another aspect of the present disclosure includes the object having pre-drilled holes in opposing sides thereof and the pair of opposing ends engaging the object in the respective pre-drilled holes on each side of the object to releasably secure the object to the system.

Another aspect of the present disclosure includes the object having a plurality of grooves in the bottom surface thereof and a corresponding pair of opposing ends engaging the object in each groove from either side of the object to releasably secure the object to the system.

Another aspect of the present disclosure includes the object being a block of pine wood from a Pinewood Derby® car kit, wherein the grooves are perpendicular to the length of the block of pine wood and the grooves are set a predetermined distance apart from one another.

Another aspect of the present disclosure includes the base further comprising a projection thereon, the projection extending transversely from the base and the projection being configured to engage the podium.

Another aspect of the present disclosure includes the podium further comprising a hollow protrusion, the hollow protrusion being configured to engage the projection.

Another aspect of the present disclosure includes the podium further comprising a stage having distal ends, wherein the stage is fixedly coupled to the projection at a center portion of the stage, and wherein the plurality of clamping mechanisms are fixedly coupled to the stage proximate the distal ends.

Another aspect of the present disclosure includes each clamping mechanism being configured to flex to permit the object to be placed therebetween and secured thereby.

Another aspect of the present disclosure includes each of the plurality of clamping mechanisms defining therebetween a workspace below the object, the workspace defining a space between the clamping mechanisms and the object.

An aspect of the present disclosure includes a method of decorating an object, the method comprising providing a base, providing a podium configured to be releasably and repeatedly coupled to the base, wherein the podium comprises a compliant clamp mechanism having opposing ends that are biased toward one another, securing the object to the podium between the opposing ends of the compliant clamp mechanism, and decorating the object secured to the podium.

Another aspect of the present disclosure includes the base supporting the podium in a substantially vertical position under the condition that the base and the podium are engaged with one another, and the podium supporting the object in a substantially horizontal position.

Another aspect of the present disclosure includes removing the podium from the base while the object remains secured to the podium, and manipulating the podium to orient the object to access surfaces of the object.

Another aspect of the present disclosure includes spinning the podium with respect to the base.

Another aspect of the present disclosure includes removing the object from the compliant clamp mechanisms, and replacing the object back into the compliant clamp mechanisms.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
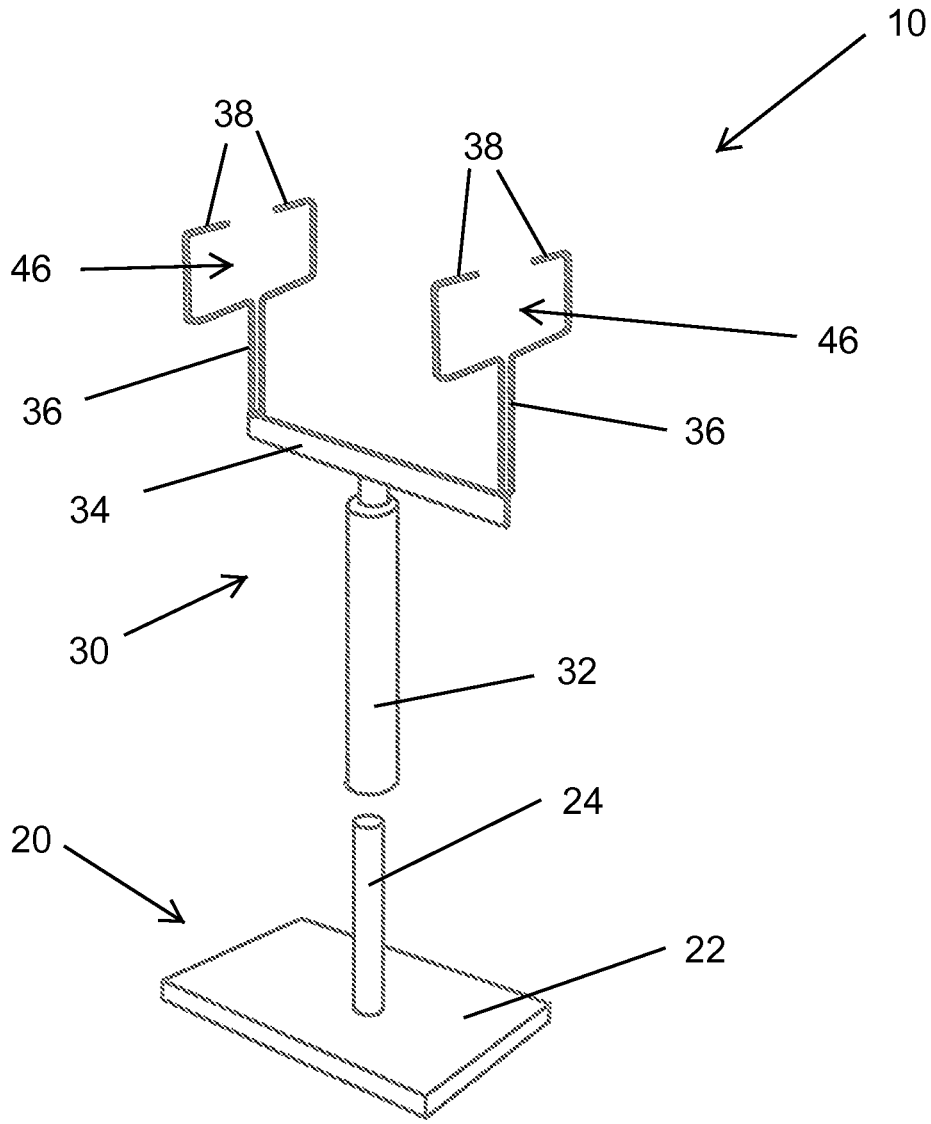
FIG. 1 is an exploded perspective view of a painting stand in accordance with the present disclosure.
Figure 2:
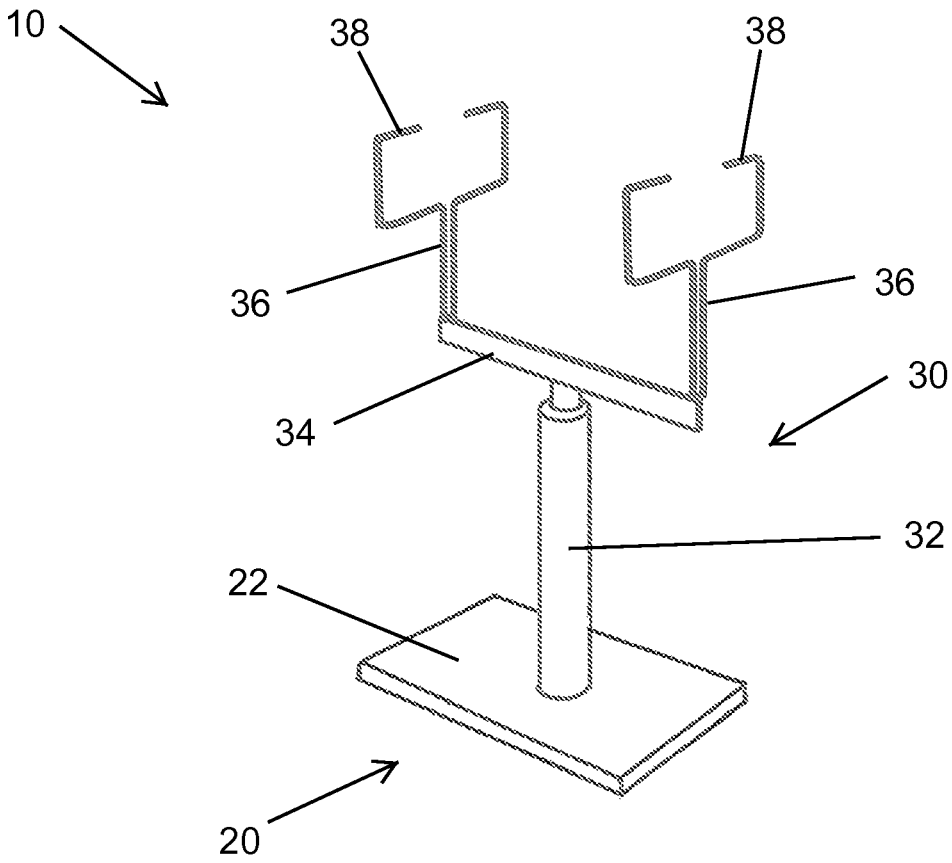
FIG. 2 is a perspective view of a painting stand in accordance with the present disclosure.

Referring to the drawings, FIGS. 1 and 2, the paint stand system 10 comprises a base 20 and a podium 30. The base 20 further comprises a support 22 and a projection 24 extending substantially transversely from the support 22. The podium 30 further comprises a hollow protrusion 32, a stage 34 coupled to the hollow protrusion 32 at substantially the midway point of the stage 34, and a compliant clamp mechanism 36 coupled proximate to each distal end of the stage 34. The hollow protrusion 32 extends substantially transversely from the stage 34.

In embodiments of the system 10, the base 20 is configured to support thereon the podium 30. The podium 30 is configured to support thereon an object 40 to be decorated. Thus, the base 20 is configured to support the podium 30 in substantially an upright position so as to allow the object 40 to be repeatedly and releasably coupled to the podium 30 as needed. Moreover, the base 20 and the podium 30 are configured to allow the podium 30 to rotate about the base 20 or, in other words, to spin at least 360° with respect to the base 20.

Embodiments of the system 10 include the hollow protrusion 32 of the podium 30 being configured to slide over and onto at least a portion of the projection 24. The hollow protrusion 32 may optionally be configured to slide over and onto the entire projection 24, as depicted in the exemplary embodiment shown in FIG. 2. The respective shapes of the projection 24 and the protrusion 32 are configured to correspond to one another to permit the hollow protrusion 32 to functionally engage the projection 24. In other words, the projection 24 and the protrusion 32 are configured to permit the outer surface of the projection 24 to engage the interior surface of the hollow protrusion 32 to thereby prevent the podium 30 from tipping over. In this configuration, the interaction between the hollow protrusion 32 and the projection 24 inserted therein provides support to the podium 30 and maintains the podium 30 in a substantially upright orientation. Additionally, with the hollow protrusion 32 configured to slide over and engage the projection 24, the user may more readily and easily disengage the podium 30 from the base 20 by gripping the hollow protrusion 32 at any point along the hollow protrusion 32 and lifting the hollow protrusion 32 up and off the projection 24.

Additionally, the hollow protrusion 32 and the projection 24 may be configured to allow the podium 30 to rotate about the projection 24, such that the podium 30 is rotatable with respect to the base 20. In other words, while the base 20 can be maintained stationary, the podium 30 can be rotated through an entire 360° rotation or more. To permit such movement between the projection 24 and the hollow protrusion 32, the hollow protrusion 32 may be configured in a hollow-tubular shape, whereas the projection 24 may be a tubular shape, as depicted in the exemplary embodiments of FIG. 1.

In alternative embodiments of the system 10, the projection 24 may be configured to be hollow and the protrusion 32 may be configured to be inserted within the hollow projection 24.

In embodiments of the system 10, the base 20 supports the weight of the podium 30. For example, one end of the hollow protrusion 32 may contact the base 20 to permit the base 20 to thereby support the podium 30. Alternatively, if the one end of the hollow protrusion 32 does not contact the base 20, then the weight of the podium 30 could be supported by an interior surface of the hollow protrusion 32 contacting the top surface of the projection 24. Nevertheless, in either embodiment, the weight of the podium 30 is supported by the base 20.

As shown in FIGS. 1-4, the podium 30 may have a plurality of compliant clamp mechanisms 36, each of the compliant clamp mechanisms 36 being coupled to the stage 34. The compliant clamp mechanisms 36 also include a pair of opposing ends 38 that are configured to be able to engage the object 40 therebetween. Each pair of opposing ends 38 is structurally configured to be biased toward one another, but yet resilient enough to be elastically bendable away from one another. In this way, each pair of opposing ends 38 may be elastically flexed away from one another, the object 40 may be placed therebetween, and the opposing ends 38 may then be released so as to return as close to their original biased position as possible with the object 40 held, seized, engaged, braced, supported, retained, pinched, or otherwise secured therebetween. Each opposing end of each pair of opposing ends 38 is oriented, aligned, and configured to lie in the same horizontal and vertical plane as the other opposing end of the same pair of opposing ends 38, such that each end of the pair of opposing ends 38 could touch one another at their end points should the pair of opposing ends 38 be flexed toward one another. Also, each pair of compliant clamp mechanisms 36 may also be flexed forward or backward along the length of the object 40 that is placed therebetween. This provides that the compliant clamp mechanisms 36 can be elastically adjusted as needed to securely and efficiently hold the object 40 therein.

The compliant clamp mechanisms 36 may further be configured to define a workspace 46 proximate the opposing ends 38, wherein the workspace 46 is an opening or gap defined by the compliant clamp mechanisms 36 in which the object 40 may be retained and yet provide ample room for the user to decorate, paint, or color the object 40 without the compliant clamp mechanisms 36 being positioned too close to the sides or bottom surface of the object 40 to interfere with the work of the user.

Figure 5:
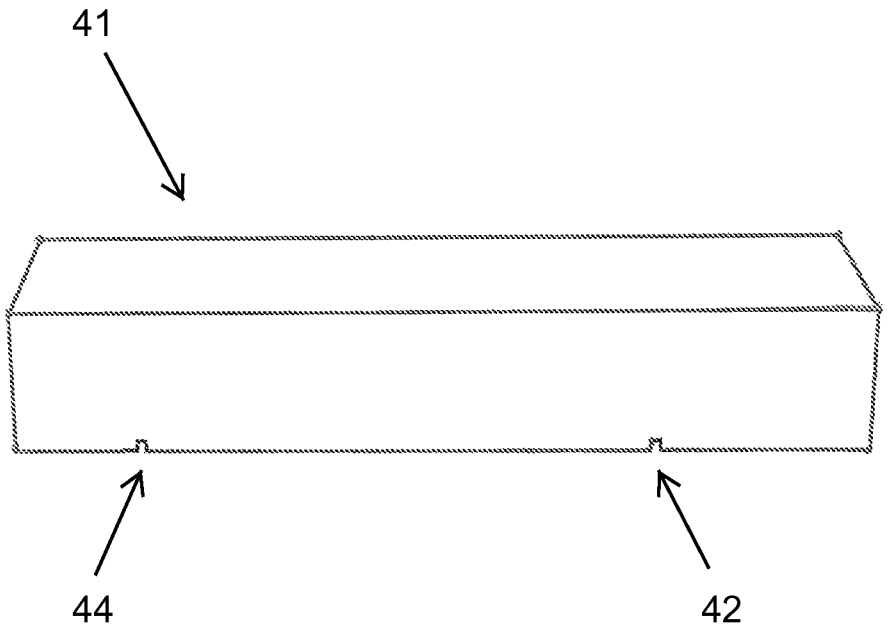
FIG. 5 (Related Art)
FIG. 5 is a perspective view of a conventional pine block included in a Pinewood Derby® car kit in accordance with the present disclosure.

Referring now to FIG. 5, a Pinewood Derby® car must satisfy certain conditions to be eligible to race in any sanctioned Pinewood Derby® competition. These conditions include, among others, that the car is at least 7 inches long, is no more than 2¾ inches wide, does not weigh more than 5 ounces, and that each pair of wheels has 1¾ inches clearance between the pair. In many, if not all approved Pinewood Derby® races, only those cars that have been prepared from the pre-cut pine block 41 provided in the Pinewood Derby® car kit may be raced in the competition. The pine block 41 provided in the Pinewood Derby® car kit, and depicted in FIG. 5, is the same in each kit and conforms to the conditions described above. For example, the pine block 41 conforms to the length and width requirements, and each pine block 41 has a front axle groove 42 and a rear axle groove 44 cut into the bottom surface of the pine block 41 for receiving the metal axles provided in the car kit. The axle grooves 42 and 44 run the entire width of the bottom surface from one side of the pine block 41 to the opposing side of the pine block 41.

Other organizations than the BSA hold and conduct their own version of the Pinewood Derby, and each of these organizations has its own rules and racing requirements. Nevertheless, many of these organizations utilize the pine block 41 as the starting point of the creation of the race car.

Under the condition that the object 40 is the pine block 41, the system 10 may be configured to have the pine block 41 supported by the podium 30 and secured by the compliant clamp mechanisms 36. For example, the opposing ends 38 of each compliant clamp mechanism 36 can be initially spaced apart a distance not more than the width of the pine block 41, which is a standard 1¾ inches wide. Specifically, the opposing ends 38 may be structured to be spaced a distance between 1 and 1½ inches away from one another. In this way, the opposing ends 38 may efficiently grip the pine block 41 that is placed therebetween without having to unduly bend or flex the compliant clamp mechanisms 36 apart from one another to facilitate the insertion of the pine block 41. Each pair of opposing ends 38 may grip, pinch, or otherwise touch the pine block 41 on opposing sides of the pine block 41 to secure the pine block 41 therebetween.

Embodiments of the system 10 include the compliant clamp mechanisms 36, and in particular the opposing ends 38 thereof, being configured to have a diameter that is complimentary to the width of the grooves 42 and 44. For example, the diameter of the opposing ends 38 may be between 0.075 and 0.100 inches, inclusive. In this way, under the condition that the opposing ends 38 are positioned in the grooves 42 and 44, an interference relationship is established that secures the pine block 41 to the system 10. For a decreased interference fit between the grooves 42 and 44 and the opposing ends 38, wherein the user may only have to use minimal force, if any, to insert the opposing ends 38 into the grooves 42 and 44, the opposing ends 38 may be configured with a diameter of between 0.075 and 0.085 inches, inclusive. For an increased interference fit between the grooves 42 and 44 and the opposing ends 38, wherein the user will likely be required to use tools or other mechanical force to insert the opposing ends 38 into the grooves 42 and 44, the opposing ends 38 may be configured with a diameter of between 0.090 and 0.100 inches, inclusive. For a normal interference fit between the grooves 42 and 44 and the opposing ends 38, wherein the user will not have to use excessive or mechanical force to insert the opposing ends 38 into the grooves 42 and 44, the opposing ends 38 may be configured with a diameter of between 0.085 and 0.090 inches, inclusive.

Figure 3:
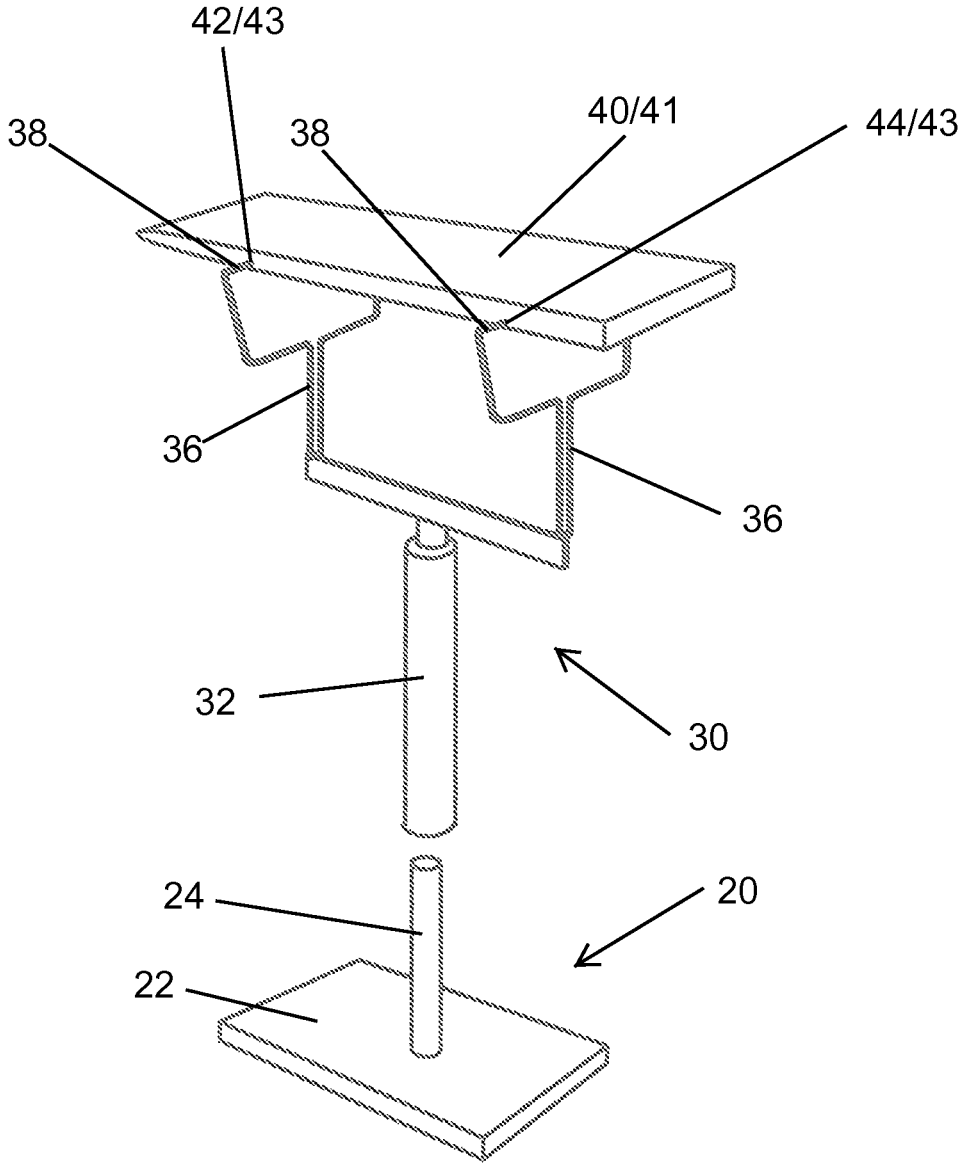
FIG. 3 is a perspective view of a painting stand and a wooden block in accordance with the present disclosure.

In addition, the pine block 41 may be placed on the podium 30 by inserting the opposing ends 38 of each pair of compliant clamp mechanisms 36 in one of the respective front and rear axle grooves 42 and 44. In this embodiment, the system 10 can be configured to account for the distance between front and rear axle grooves 42 and 44, which are positioned 4⅜ inches apart. Accordingly, the compliant clamp mechanisms 36 may be configured such that the compliant clamp mechanisms 36 are placed about 4⅜ inches apart on the stage 34, so as to be the about the same distance apart as the front and rear axle grooves 42 and 44. In this way, opposing ends 38 of one pair of compliant clamp mechanisms 36 can be placed in the front groove 42 and the opposing ends 38 of the other pair of compliant clamp mechanisms 36 can be placed in the rear groove 44. Accordingly, once the pine block 41 is placed in the compliant clamp mechanisms 36, the compliant clamp mechanisms 36 thereafter retain the pine block 41 by the front and rear axle grooves 42 and 44 in a suspended position, as shown in FIG. 3, so that a user can apply paint, decorate, or otherwise work on the decorative or functional aspects of the pine block 41 to prepare the pine block 41 for racing. Moreover, the ability of the podium 30 to spin about the stationary base 20 allows the user to remain in one position and rotate the pine block 41 about the base 20 to access the different surfaces of the pine block 41. In that regard, the user may even remove the podium 30 from the base 20, as described above, and manually maneuver the podium 30 with the pine block 41 secured therein to more efficiently access the bottom surfaces of the pine block 41.

An advantage of the system 10 being configured to engage the pine block 41 in the front and rear axle grooves 42 and 44 is that the system 10 may be utilized without having to further alter the pine block 41 from its original configuration, as the front and rear grooves 42 and 44 are pre-cut in the pine block 41 before being included in the Pinewood Derby® car kit. Thus, the system 10 is ready to use with the pine block 41 right out of the box.

Figure 4:
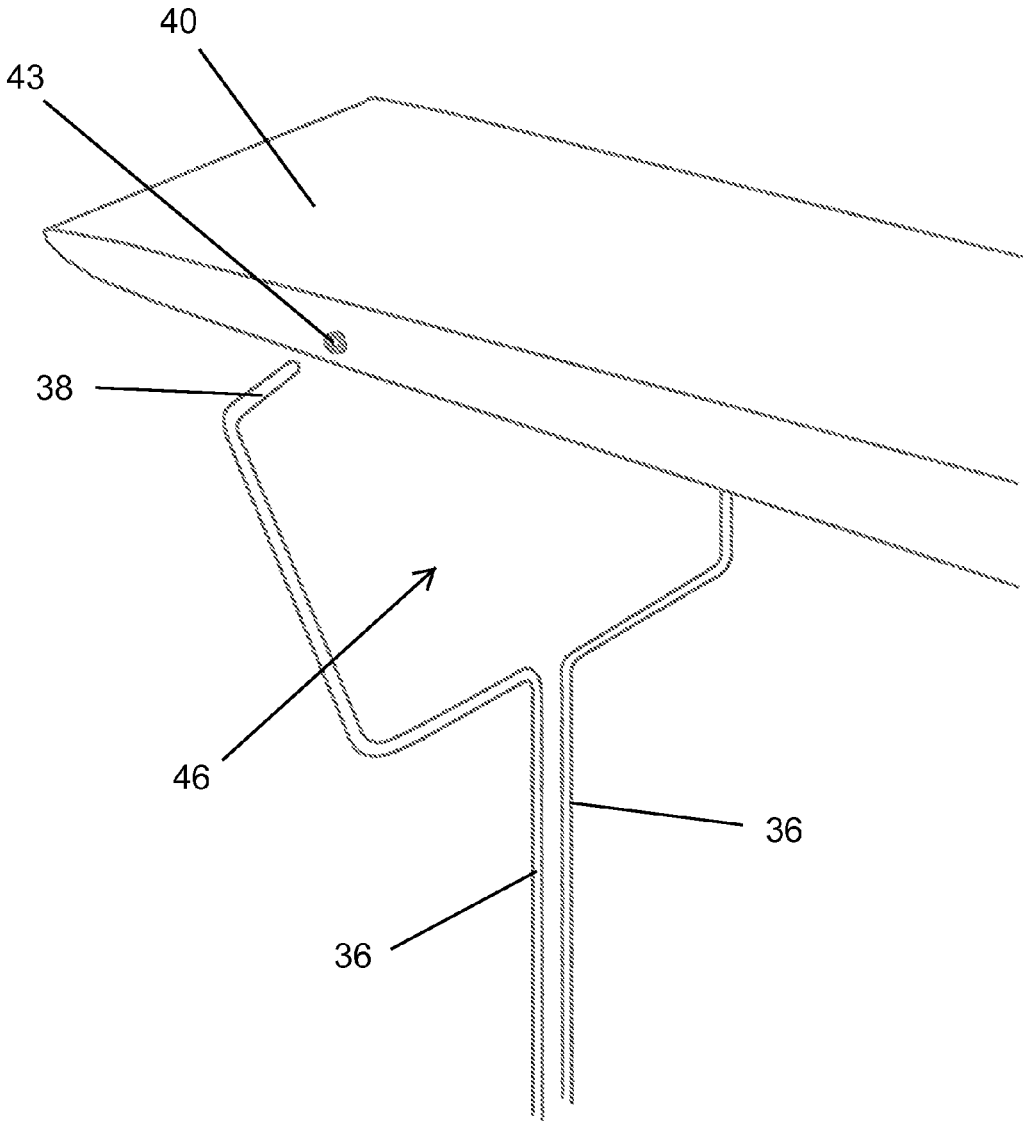
FIG. 4 is a perspective view of a portion of the painting stand and wooden block in accordance with the present disclosure.

In additional embodiments of the system 10, the opposing ends 38 of the compliant clamp mechanisms 36 may also be configured to be inserted in pre-drilled holes 43 in the opposing sides of the object 40, or the pine block 41, as the case may be. An exemplary embodiment of an opposing end 38 and a pre-drilled hole 43 are depicted in FIG. 4.

With reference to the structure and accompanying use of the system 10 described above, a method of using the system 10 will herein be described. A method of using the system 10 includes providing a base and providing a podium that can be releasably and repeatedly coupled to the base such that the base supports the podium in an upright position under the condition that the base and the podium are engaged with one another. The method further includes engaging an object in the podium and securing the object between opposing ends of compliant clamp mechanisms. The method further includes securing the object in pre-cut grooves in the object so as to avoid altering the object from its original condition or from its prescribed required configuration. The method further includes removing the podium from the base while the object nevertheless remains secured by the podium, so as to manipulate the object within the podium without restriction by the base. The method further includes spinning the podium about the base under the condition that the base and the podium are engaged with one another. The method further includes coloring, painting, or decorating the object under the condition that the object is secured by the podium. The method further includes leaving the object in the podium after coloring, painting, or decorating the object to permit the object to dry. The method further includes removing the object from the podium at any stage during the method to manipulate the object and thereafter placing the object back in the podium to continue the method. The method further includes repetition of any of the foregoing method steps.

The components defining any embodiment of a paint stand system 10 may be formed of any of many different types of materials or combinations thereof that can readily be formed into shaped objects provided that the components selected are consistent with the intended operation of system 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of the paint stand system 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A paint stand comprising:

a base having a projection, the projection extending transversely from the base;

a podium having a hollow protrusion, the hollow protrusion being configured to fit over and functionally engage the projection, the projection being configured to be repeatedly and releasable coupled to the protrusion, the podium being configured to rotate with respect to the base;

a stage coupled to the podium, the stage being positioned above the base, projection, and protrusion with respect to a surface upon which the stand rests; and a plurality of clamping mechanisms functionally coupled to the stage, each of the plurality of clamping mechanism protruding from the stage in a direction opposite the projection, each of the clamping mechanisms comprising a first wire member and a second wire member, each of the first and second wire members having a first end and a second end, the respective first ends being coupled to the stage and the respective second ends having an end section being oriented substantially in parallel with the base, each of the end sections having a distal end, the distal ends facing one another gap therebetween, the first and second wire members being biased toward one another without closing the gap, the first and second wire members being configured to flex apart to widen the gap between the distal ends, and wherein the stage is fixedly coupled to the protrusion at a center portion of the stage, and wherein the plurality of clamping mechanisms are fixedly coupled to the stage at the first end.

2. The paint stand of claim 1, wherein each of the first and second wire members is configured to have a diameter between 0.075 and 0.0100 inches, inclusive.

3. The paint stand of claim 2, wherein each of the first and second wire members further comprises a widened section between the first end and the second end, the widened section defining a workspace between the first and second wire members that is positioned below the gap and is wider than the gap.

4. A paint stand system for securing therein an object to be painted, the system comprising:

a base having a projection extending therefrom;

a podium having a protrusion, the protrusion being configured to be rotatably and releasably coupled to the projection, wherein the podium is configured to rotate with respect to the base;

a stage connected to the podium;

an object having a plurality of grooves in a bottom surface thereof; and a plurality of clamping mechanisms functionally coupled to the podium, each of the plurality of clamping mechanisms corresponds to a groove of the plurality of grooves, each of the clamping mechanisms comprising a first wire member and a second wire member, each of the first and second wire members having a first end and a second end, the respective first ends being coupled to the stage and the respective second ends having an end section being oriented substantially in parallel with the base, each of the end sections having a distal end, the distal ends facing one another with a gap therebetween, the first and second wire members being biased toward one another without closing the gap, the first and second wire members being configured to flex apart to widen the gap between the distal ends, wherein under a condition the first and second wire members are flexed apart to widen the gap, the object is releasably secured in the gap between the distal ends, and wherein the distal ends are configured to be inserted into the corresponding groove of the plurality of grooves such that a portion of the end section is encompassed by the groove and held in place within the groove by friction fit.

5. The system of claim 4, wherein the object has pre-drilled holes in opposing sides thereof and the distal ends engage the object in the respective pre-drilled holes on each side of the object to releasably secure the object to the system.

6. The system of claim 4, wherein the object is a block of wood sold as part of a Pinewood Derby car kit and the grooves are perpendicular to the length of the block of wood, the grooves being set a predetermined distance apart from one another, and the clamping mechanisms are set apart from one another on the podium a distance substantially equal to the predetermined distance.

7. The system of claim 4, wherein the projection extends transversely from the base and the protrusion extends from the podium.

8. The system of claim 4, wherein the protrusion is hollow, the hollow protrusion being configured to engage the projection.

9. The system of claim 8, wherein the stage further comprises distal ends, wherein the stage is fixedly coupled to the protrusion at a center portion of the stage, wherein the plurality of clamping mechanisms are fixedly coupled to the stage proximate the distal ends of the stage, and wherein the plurality of clamping mechanisms retain the object above the base, the projection, and the protrusion with respect to a surface upon which the system rests.

10. The system of claim 4, wherein each of the first and second wire members is configured to have a diameter between 0.075 and 0.0100 inches, inclusive.

11. A method of decorating an object, the method comprising:

providing a base;

providing a podium configured to be releasably and repeatedly coupled to the base, wherein the podium comprises a stage coupled thereto and a plurality of compliant clamp mechanisms coupled to the stage, each compliant clamp mechanism comprising a first wire member and a second wire member, the first and second wire members having a first end and a second end, the respective first ends being coupled to the stage and the respective second ends having an end section being oriented substantially in parallel with the base, each of the end sections having a distal end, the distal ends facing one another with a defined gap therebetween;

biasing the first and second wire members of each of the compliant clamp mechanisms toward one another while maintaining the gap therebetween;

flexing the first and second wire members apart from one another to widen the gap;

placing the object into the widened gap between flexed first and second wire members;

inserting each of the distal ends into a corresponding groove in the object;

encompassing at least a portion of end sections with the corresponding groove to secure the object in the gap by friction fit between the end portions and the corresponding groove; and decorating the object.

12. The method of claim 11, wherein the base supports the podium in a substantially vertical position under the condition that the base and the podium are engaged with one another, and wherein the podium supports the object in a substantially horizontal position.

13. The method of claim 11, further comprising removing the podium from the base while the object remains secured to the podium; and manipulating the podium to orient the object to access surfaces of the object.

14. The method of claim 11, further comprising spinning the podium with respect to the base.

15. The method of claim 11, further comprising removing the object from the compliant clamp mechanisms; and replacing the object back into the compliant clamp mechanisms.

* * * * *